US009737760B2

(12) United States Patent
Harrer et al.

(10) Patent No.: US 9,737,760 B2
(45) Date of Patent: Aug. 22, 2017

(54) TREADMILL ERGOMETER HAVING ADAPTED PULLING AND MEASURING UNITS FOR THERAPEUTIC APPLICATIONS AND FOR GAIT TRAINING AND RUNNING TRAINING

(75) Inventors: Franz Harrer, Bergen (DE); Günther Beutel, Oberstenfeld (DE)

(73) Assignee: FRANZ HARRER, Bergen (DE)

( * ) Notice: Subject to any disclaimer, the term of this patent is extended or adjusted under 35 U.S.C. 154(b) by 0 days.

(21) Appl. No.: 13/884,147

(22) PCT Filed: Nov. 9, 2011

(86) PCT No.: PCT/DE2011/001955

§ 371 (c)(1),
(2), (4) Date: May 8, 2013

(87) PCT Pub. No.: WO2012/062283

PCT Pub. Date: May 18, 2012

(65) Prior Publication Data

US 2013/0225371 A1 Aug. 29, 2013

(30) Foreign Application Priority Data

Nov. 12, 2010 (DE) ..... 20 2010 015 329 U

(51) Int. Cl.
*A63B 71/00* (2006.01)
*A63B 22/02* (2006.01)
(Continued)

(52) U.S. Cl.
CPC ..... *A63B 24/0087* (2013.01); *A63B 21/0552* (2013.01); *A63B 21/154* (2013.01);
(Continued)

(58) Field of Classification Search
CPC ..... A63B 21/00058; A63B 21/00069; A63B 21/00072; A63B 21/012; A63B 21/0125;
(Continued)

(56) References Cited

U.S. PATENT DOCUMENTS 4,625,962 A * 12/1986 Street ..... A63B 21/015 482/116
5,444,812 A * 8/1995 Thibodeau ..... A63B 22/02 388/838
(Continued)

FOREIGN PATENT DOCUMENTS

DE 597 08 289 11/1999
EP 958 004 11/1999
(Continued)

OTHER PUBLICATIONS

International Preliminary Report mailed May 23, 2013 for the corresponding PCT Application No. PCT/DE2011/001955.
(Continued)

*Primary Examiner* — Joshua Lee
(74) *Attorney, Agent, or Firm* — Leason Ellis LLP

(57) ABSTRACT

A treadmill ergometer for therapeutic applications and/or intense running training is connected to one or more force pull-out units. The force pull-out units can be connected at the free end area thereof to limbs and/or the body of a training person in such a way that a force is applied to the limb(s) or the body when the limb and/or the body moves.

12 Claims, 13 Drawing Sheets

(51) Int. Cl.

| | |
|---|---|
| ***A63B 21/02*** | (2006.01) |
| ***A63B 24/00*** | (2006.01) |
| ***A63B 21/055*** | (2006.01) |
| ***A63B 21/00*** | (2006.01) |
| ***A63B 21/16*** | (2006.01) |
| ***A63B 22/00*** | (2006.01) |
| *A63B 21/04* | (2006.01) |
| *A63B 71/06* | (2006.01) |

(52) U.S. Cl.
CPC ..... *A63B 21/16* (2013.01); *A63B 21/4011* (2015.10); *A63B 21/4015* (2015.10); *A63B 21/4017* (2015.10); *A63B 21/4019* (2015.10); *A63B 22/0005* (2015.10); *A63B 21/0442* (2013.01); *A63B 21/0557* (2013.01); *A63B 22/02* (2013.01); *A63B 2071/065* (2013.01); *A63B 2220/20* (2013.01)

(58) Field of Classification Search
CPC ..... A63B 21/015; A63B 21/018; A63B 21/02; A63B 21/021; A63B 21/04; A63B 21/0435; A63B 21/0442; A63B 21/055; A63B 21/0552; A63B 21/0557; A63B 21/15; A63B 21/153; A63B 21/157; A63B 21/4011; A63B 21/4015; A63B 21/4017; A63B 21/4019; A63B 21/4025; A63B 21/4039; A63B 22/0002; A63B 22/0005; A63B 22/0007; A63B 22/001; A63B 22/0012; A63B 22/0015; A63B 22/0017; A63B 22/0025; A63B 22/0046; A63B 22/0048; A63B 22/02; A63B 2022/002; A63B 2202/003; A63B 2202/0033; A63B 2202/0035; A63B 2202/0038; A63B 2202/0041; A63B 2202/0043; A63B 2202/0053; A63B 23/035; A63B 23/03508; A63B 23/03516; A63B 23/03525; A63B 23/03533; A63B 23/03541; A63B 23/0355; A63B 23/03558; A63B 23/03583; A63B 23/03591; A63B 23/04; A63B 23/12; A63B 69/0028; A63B 2225/09; A63B 2225/096; A63B 2225/10; A63B 2225/102; A63B 2225/105; A63B 2225/107; A63B 24/00; A63B 24/0087
USPC ..... 482/1, 8, 54
See application file for complete search history.

(56) References Cited

U.S. PATENT DOCUMENTS

| | | | | |
|---|---|---|---|---|
| 5,707,319 | A * | 1/1998 | Riley | A63B 22/001 482/54 |
| 5,951,449 | A * | 9/1999 | Oppriecht | A63B 21/0087 482/103 |
| 6,042,516 | A * | 3/2000 | Norton | A63B 22/0002 482/54 |
| 6,123,649 | A * | 9/2000 | Lee | A63B 21/153 482/51 |
| 6,152,854 | A * | 11/2000 | Carmein | A63B 22/025 198/779 |
| 6,450,923 | B1 * | 9/2002 | Vatti | A63B 21/00181 482/51 |
| 7,998,040 | B2 * | 8/2011 | Kram | A63B 21/00181 482/124 |
| 9,084,712 | B2 * | 7/2015 | Roerdink | A61H 3/00 |
| 2004/0043873 | A1 * | 3/2004 | Wilkinson | A63B 22/0005 482/54 |
| 2004/0087418 | A1 * | 5/2004 | Eldridge | A63B 21/157 482/54 |
| 2005/0032613 | A1 * | 2/2005 | Wehrell | A63B 21/4007 482/133 |
| 2005/0124471 | A1 * | 6/2005 | Wilkinson | A63B 22/0005 482/121 |
| 2006/0281606 | A1 * | 12/2006 | Radow | A63B 22/0235 482/54 |
| 2007/0287601 | A1 | 12/2007 | Burck et al. | |
| 2009/0156372 | A1 | 6/2009 | Solomon | |
| 2010/0035727 | A1 * | 2/2010 | Brunner | A61B 5/1038 482/8 |
| 2010/0152629 | A1 * | 6/2010 | Haas, Jr. | A61B 5/1038 601/34 |
| 2010/0160115 | A1 * | 6/2010 | Morris et al. | 482/4 |
| 2010/0279827 | A1 * | 11/2010 | Farnsworth | A63B 23/1209 482/54 |

FOREIGN PATENT DOCUMENTS

| | | | |
|---|---|---|---|
| EP | 1 137 378 | A2 | 10/2001 |
| EP | 1 221 331 | A2 | 7/2002 |
| EP | 1 772 134 | A1 | 4/2007 |
| WO | WO-2004/050191 | A1 | 6/2004 |

OTHER PUBLICATIONS

German Search Report mailed Feb. 8, 2012 for the related German Application No. 10 2010 051 083.1.
International Search Report mailed May 30, 2012 for the corresponding PCT Application No. PCT/DE2011/001955.

* cited by examiner

TREADMILL ERGOMETER HAVING ADAPTED PULLING AND MEASURING UNITS FOR THERAPEUTIC APPLICATIONS AND FOR GAIT TRAINING AND RUNNING TRAINING

CROSS-REFERENCE TO RELATED PATENT APPLICATIONS

This application is a U.S. National Phase Application under U.S.C. §371 of International Patent Application No. PCT/DE2011/001955, filed Nov. 11, 2011, and claims the benefit of German Patent Application No. 20 2010 015 329.8, filed Nov. 12, 2010, all of which are incorporated by reference herein. The International Application was published in German on May 18, 2012 as International Publication No. WO/2012/062283 under PCT Article 21(2).

FIELD OF THE INVENTION

The present invention relates to a treadmill ergometer having adapted pulling and measuring units for therapeutic applications and for gait training and running training.

BACKGROUND OF THE INVENTION

There are known training concepts in which treadmill training involves using expander straps or elastic bands that are held by the therapists to offer a resistance to the person undertaking the training, or to provide relief to the lower extremities, and patented pulling units, to be specific those of EP 1 221 331, which are fastened to fitness devices, profiled bars for use on fitness devices shown in DE 597 08 289 or else walls and rubber pulling straps with tension balances and belaying cleats integrated on the pulling hooks for indicating and setting the training force, as presented to the public for the first time on the Body-Spider fitness device at the FIBO fitness trade fair in Essen at the end of April 2000.

There are other known training concepts in which treadmill training involves using a device and a method known from EP 1 137 378 for automating the treadmill therapy.

SUMMARY OF THE INVENTION

The invention is based on the object or addresses the technical problem of providing on the basis of the cited prior art a device which during treadmill training also optimally allows the training of the upper body half, the pulling of the force pull-outs, from positions that are specifically desired and can be changed during the training, for corresponding gait patterns and gait corrections, the relieving of the lower extremities, the recording by measuring instruments of the pulling-out forces and positions of the pulling units, documented and prescribed as a training plan, and also forming the device in such a way that there is no additional source of potential risk and the device can be adapted as easily as possible to different treadmills.

The treadmill ergometer according to the invention contains adapted pulling and measuring units for therapeutic applications and more intensive running training.

The treadmill ergometer according to the invention is accordingly distinguished by the fact that there is/are connected to the treadmill ergometer at least one, in particular a number of, force pull-out unit(s), which can be connected in its/their free end region to limbs and/or the body of a training person in such a way that, when there is movement of the limbs and/or the body, a force is exerted on the limb/limbs or the body.

In a structurally particularly simple embodiment, the force pull-out units are preferably formed such that they can be pulled out elastically, in particular comprising a pulling cable.

An embodiment providing the optimum training possibilities, having a left-hand and a right-hand front training unit, is distinguished in terms of the object presented or in terms of the problem presented by the fact that both training units are attached pivotably to the entry of the treadmill, and that these training units are formed with modified pulling units, which are displaceable in the vertical direction.

An embodiment providing the optimum training possibilities, having a left-hand and a right-hand rear training unit, attached to the end of the treadmill ergometer, is distinguished in terms of the object presented or the problem presented by the fact that both training units are formed with modified pulling units, which are displaceable both in the horizontal direction and in the vertical direction.

According to the invention, the treadmill ergometer is fitted with pulling units which are attached to the entry and the end of the treadmill ergometer and are formed in such a way that the pulling units are pivotably attached to the entry of the treadmill ergometer, in order that an individual position of the pulling units can be realized. An essential aspect here is that these pulling units can be displaced both in the horizontal direction and in the vertical direction, the pulled-out forces and positions of the pulling units can be recorded by measuring instruments, documented and predetermined as a training plan, so that this invention meets the given requirements in particular in the area of therapeutic application. An important criterion in the case of the invention is also that these pulling units can be fastened to different treadmill ergometers, without modifying the latter, by corresponding adapters.

A preferred refinement of the invention is distinguished by the fact that all of the displaceable pulling units are led over a guiding bar, in particular formed as a square, provided with locking holes, and, provided with a locking pin, can be locked in the desired position.

In order that a pretensioning of the pulling-out forces, and consequently an increase thereof, is possible in the case of these displaceable pulling units, the invention is distinguished by the fact that the belaying cleats that are described in the prior art and are depicted in FIG. 1 are not arranged separately but are integrated in the displaceable pulling units, and consequently are displaceable with the pulling unit.

A further refinement of the invention is distinguished by the fact that the displaceable pulling units, adapted to commercially available linear units, can be brought into the desired training position by means of electromotive adjustment, in particular triggered by a deadman switch, both in the horizontal direction and in the vertical direction.

An exclusive version of the invention is distinguished by the fact that the displaceable and pivotable pulling units, adapted to commercially available linear units, can be brought into the desired training position by means of electromotive adjustment with integrated position monitoring, triggered by a data transfer from a central unit, or by a deadman switch, both in the horizontal and vertical directions and in the pivoting axes of the front pulling units.

A further exclusive version of the invention is distinguished by the fact that the pulling units do not consist of rubber pulling units (known colloquially as "expanders"), but of cables that are fastened to other pulling force elements, for example to commercially available electronic servo drives, pneumatic or hydraulic drives, weight plates with roller deflection, torsion spring pretensioning devices or comparable pulling devices which produce a settable pulling force and/or also are adjustable during training in the pulling force and in the pulling direction manually or electronically or automatically on the basis of a program presetting or maximum value/minimum value parameter presetting.

A further exclusive version of the device is distinguished by the fact that in a treadmill ergometer there are incorporated in the running surface commercially available force measurements and/or pressure distributions, which on a display give a visual check-back indication (biofeedback) to the test person and thus show the test person the success of the gait pattern improvement, and in addition electronically control the pulling units in the pulling loading and/or pulling direction in such a way that the gait pattern of the test person corresponds to the presettings of the therapist and the standard values and/or are synchronized and/or leads to an identical gait pattern and identical ground reaction forces on both feet.

For an exact determination of the pulled pulling forces, in a further embodiment of the invention the pulling units that are disclosed in the prior art are modified in such a way that the deflection rollers of the pulling units are arranged separately, provided with a centrally connected linear potentiometer, and these data determined by measuring instruments are indicated on a display, attached to the pulling units.

An exclusive version of the invention is distinguished by the fact that the measurement data of the built-in linear potentiometers are evaluated by data transfer to a central unit and the respective difference obtained from the initial value and the end value is also used for the purpose of determining the respective training cycles.

With the use of a central unit, the linear potentiometers, the motor-adjustable pulling units and the positional monitoring thereof, the determination, evaluation, indication and preparation of training plans and storing of training plans, in particular for reproducible training, and the documentation of all the training-relevant parameters, are possible by a bidirectional data transfer.

BRIEF DESCRIPTION OF THE DRAWING

The invention and advantageous embodiments and developments of the same are described and explained in more detail below on the basis of the examples represented in the drawings. The features that can be taken from the description and the drawings can be applied according to the invention individually on their own or multiply in any desired combination.

DETAILED DESCRIPTION OF THE INVENTION

Figure 1:
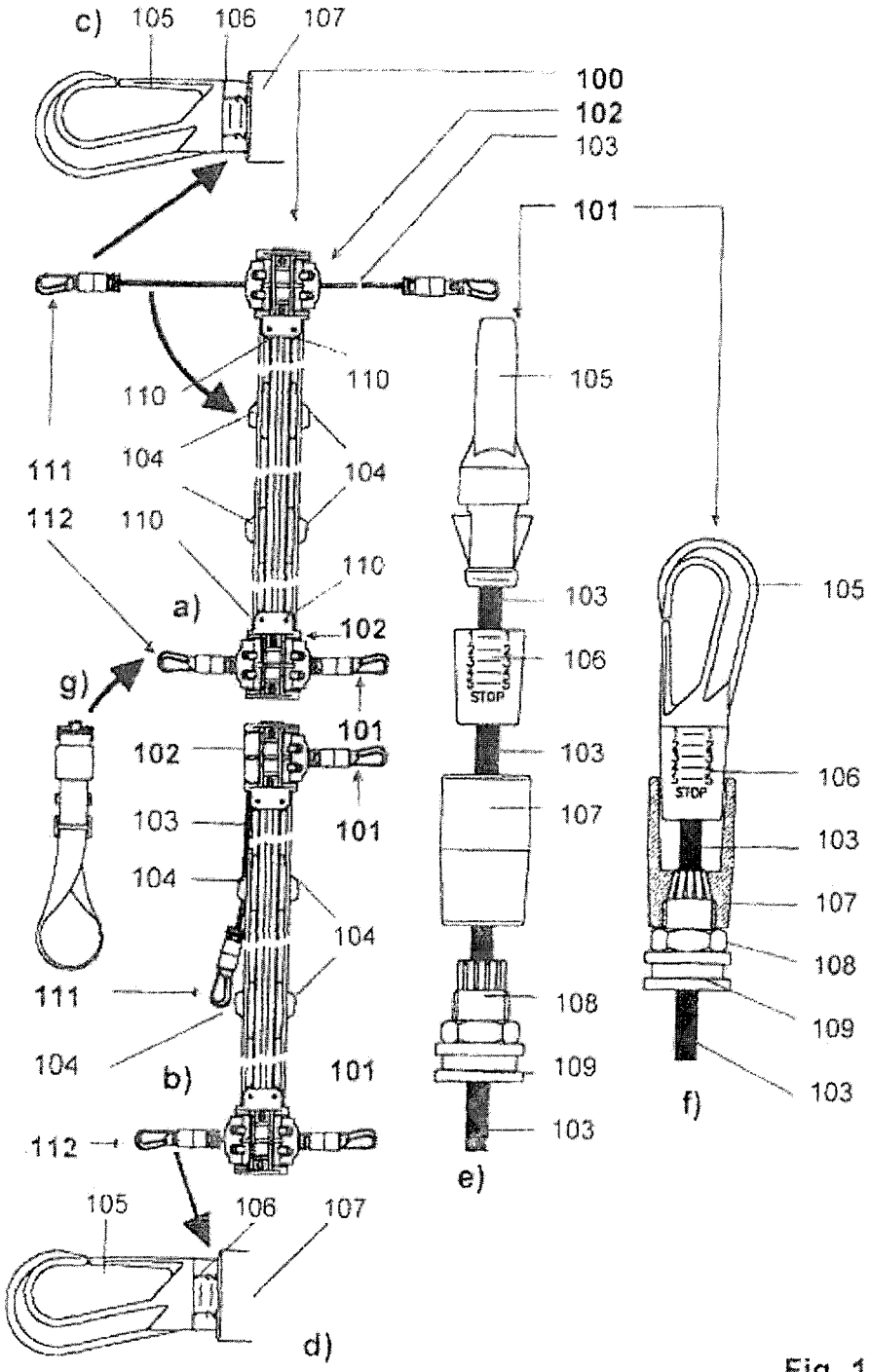
FIG. 1 shows the prior art with respect to the built-in pulling units of the increase of the pulling forces by means of pretensioning the rubber pulling strap (FIG. 1*a*)), and the subsequent placing of the pretensioned rubber pulling strap into the respective belaying cleat (FIG. 1*b*)), and in an enlargement the indicated pulling forces of the spring tension balances during the pretensioning (FIG. 1*c*)), the indicated initial force during the pulling of the actual training pull-out (FIG. 1*d*)), the structure of the spring tension balances in the non-screwed state (FIG. 1*e*)), and in the screwed state, adjusted for indicating the almost exact pulling forces (FIG. 1*f*)), likewise, in an enlargement, and the schematic representation of a training loop (FIG. 1*g*)), which for training can be clipped into the pulling hooks of the force pull-outs and is ideally suited for training on this unit.

According to FIGS. 5, 6, 9, 10, a treadmill ergometer 300 has a front training unit 400, which by means of adapter unit 450 to the right-hand front side of the treadmill ergometer, and an adapter unit 460 to the left-hand front side of the treadmill ergometer, which are fastened in the respective frame profiles 304, a rear training unit 500, which is fastened by means of an adapter unit 510 to a weight-relieving and safety system 301, or by means of an adapter unit for treadmill handrails 520 in such a way that there is the possibility of realizing this without additionally providing bores or fastening means welded to the treadmill ergometer 300.

Figure 7:
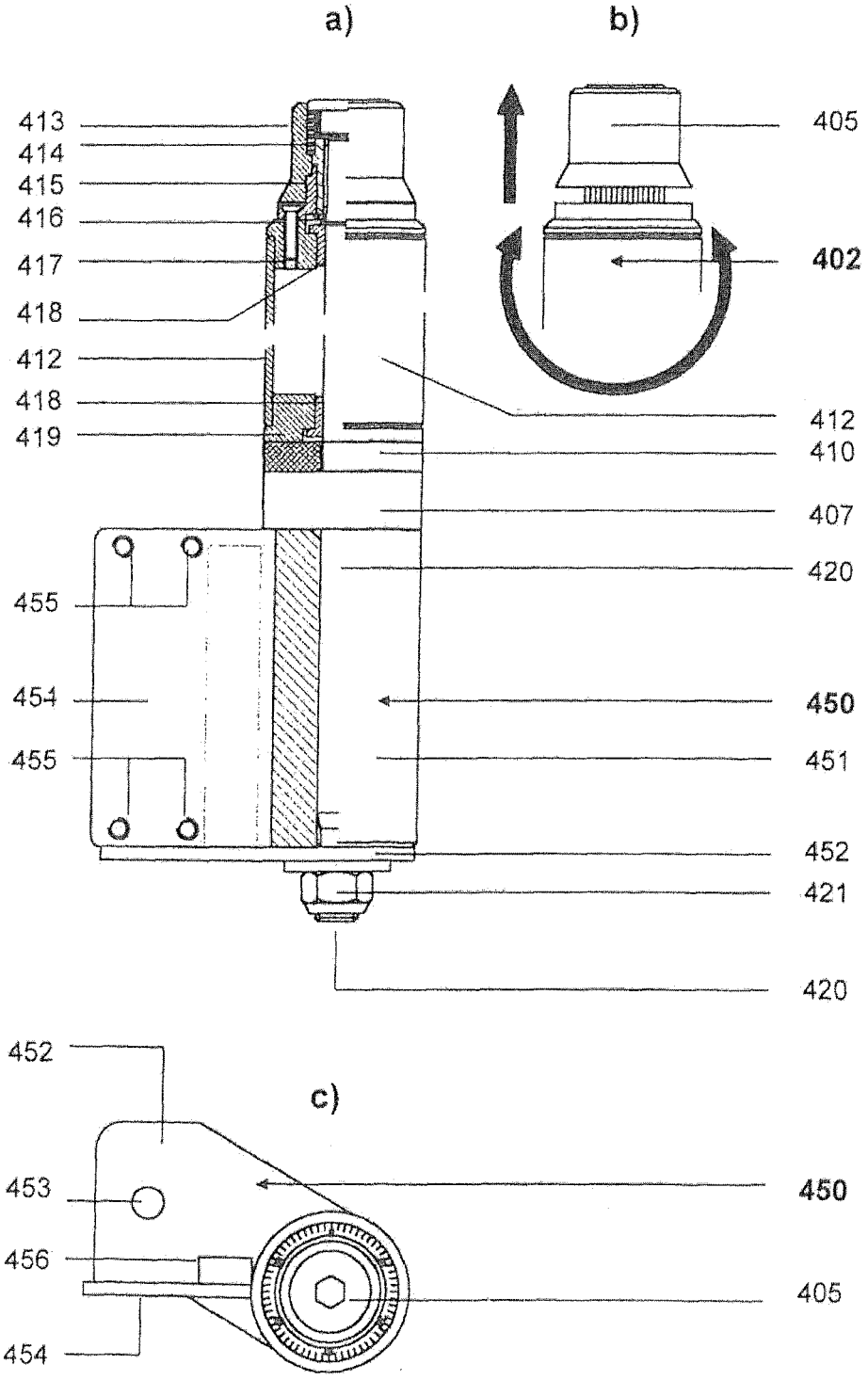
FIG. 7 shows a detail of the front right-hand training unit in a front view (FIG. 7*a*)) and in a plan view (FIG. 7*c*)), which shows the possibility of fastening to a treadmill ergometer, and in a side view (FIG. 7*b*)) the operating principle of the locking elements for the adjustment of the front training units.
Figure 8:
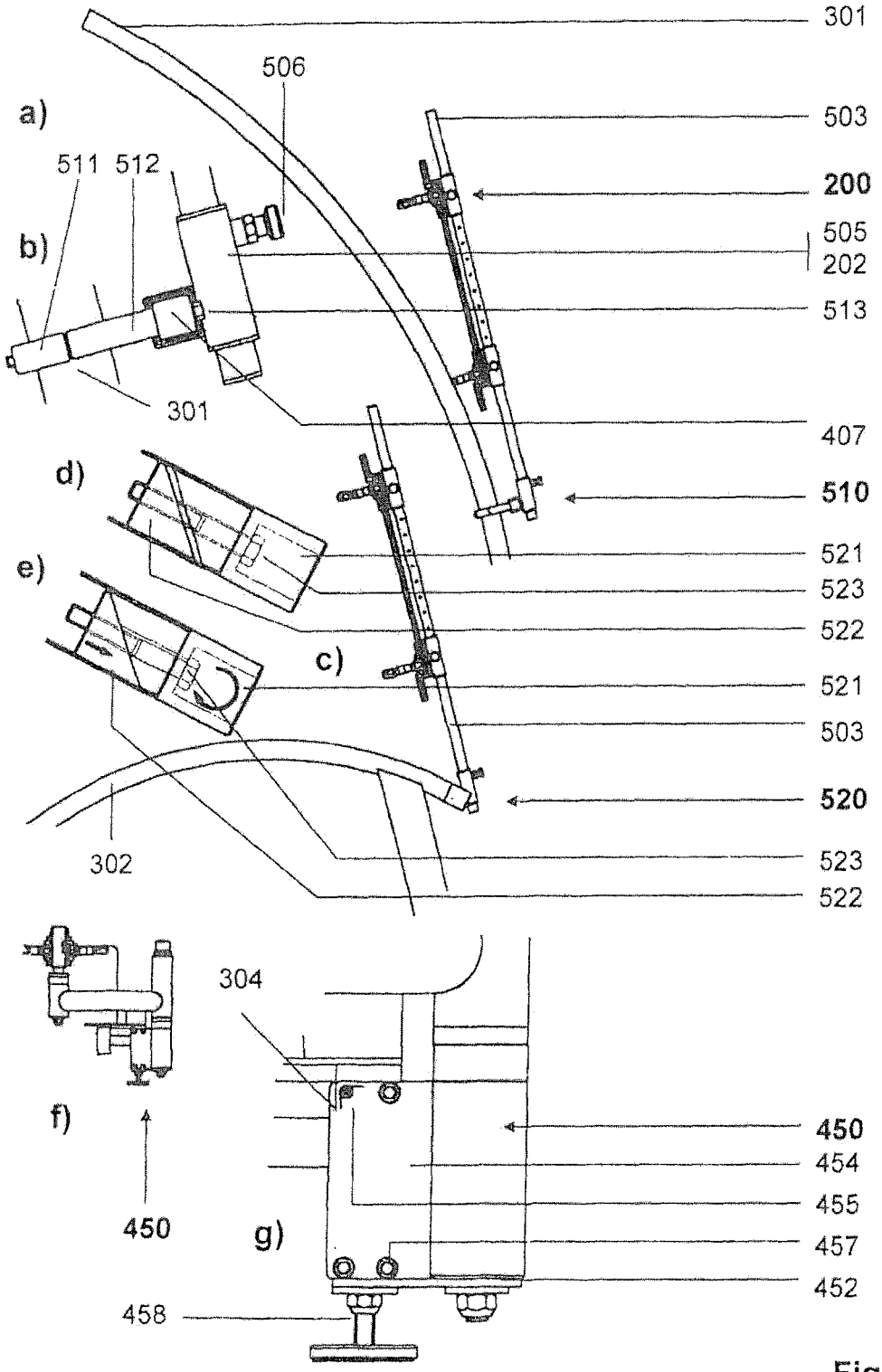
FIG. 8 shows for clarification in a side view the fastening of the rear training units to a weight relieving system (FIG. 8*a*)), an enlargement of this fastening (FIG. 8*b*)), the adaptation of the rear training unit directly into the profile cross sections of handrail tubes (FIG. 8*c*)) and in two enlargements (FIG. 8*d*)) and (FIG. 8*e*)) the method of functioning of the clamping of this mechanism in the handrail tubes, and the fastening of the front training units (FIG. 8*f*)) and in an enlargement (FIG. 8*g*)) the fastening of this training unit in the frame profile of treadmill ergometers.
Figure 9:
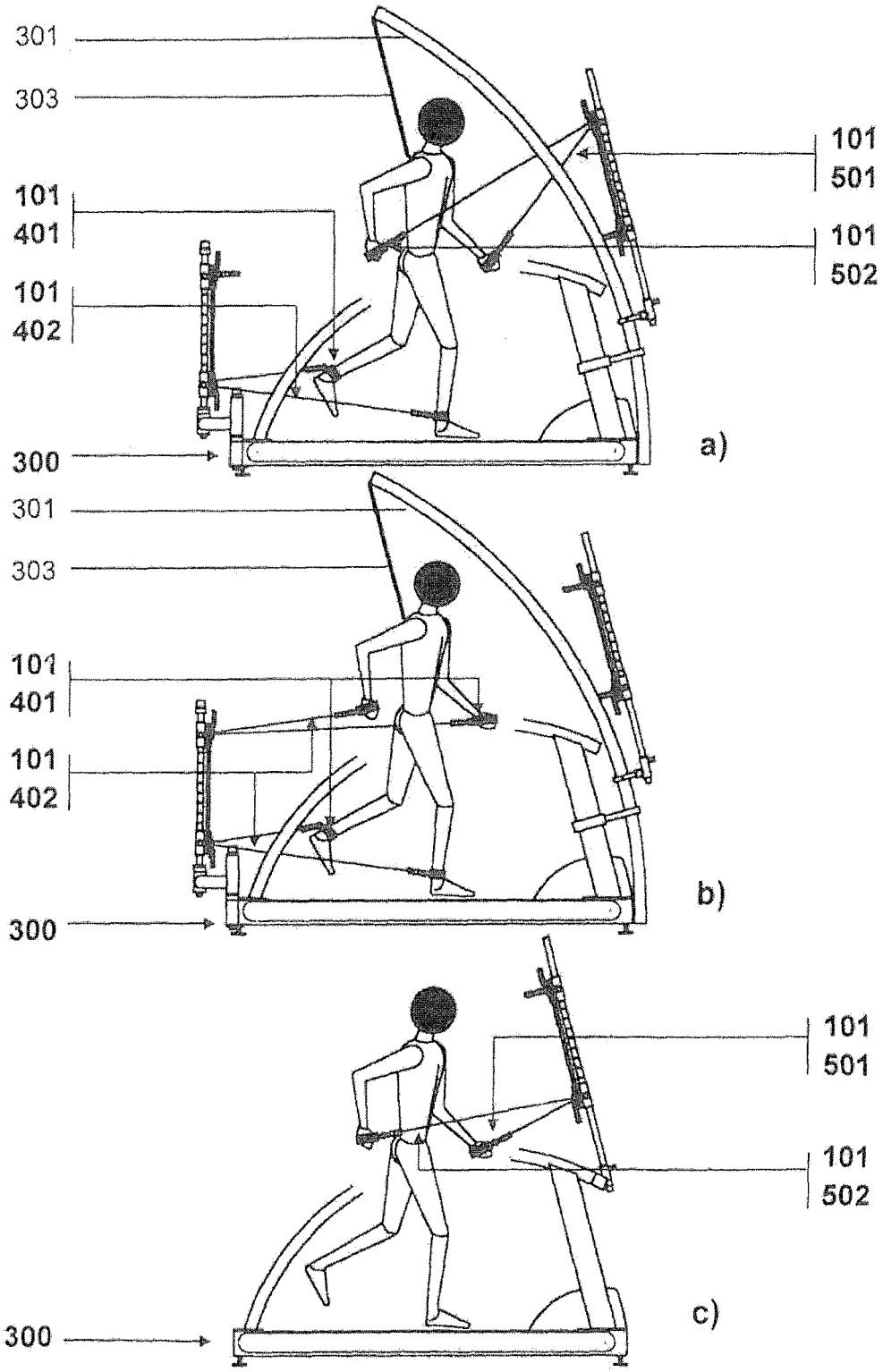
FIG. 9 shows as examples of exercises the training of the upper body half on the rear training units and the lower body half on the front training units (FIG. 9*a*)), the training of the upper and lower body halves on the front training units (FIG. 9*b*)), and the training of the upper body half on the individually adaptable rear training units (FIG. 9*c*))
Figure 10:
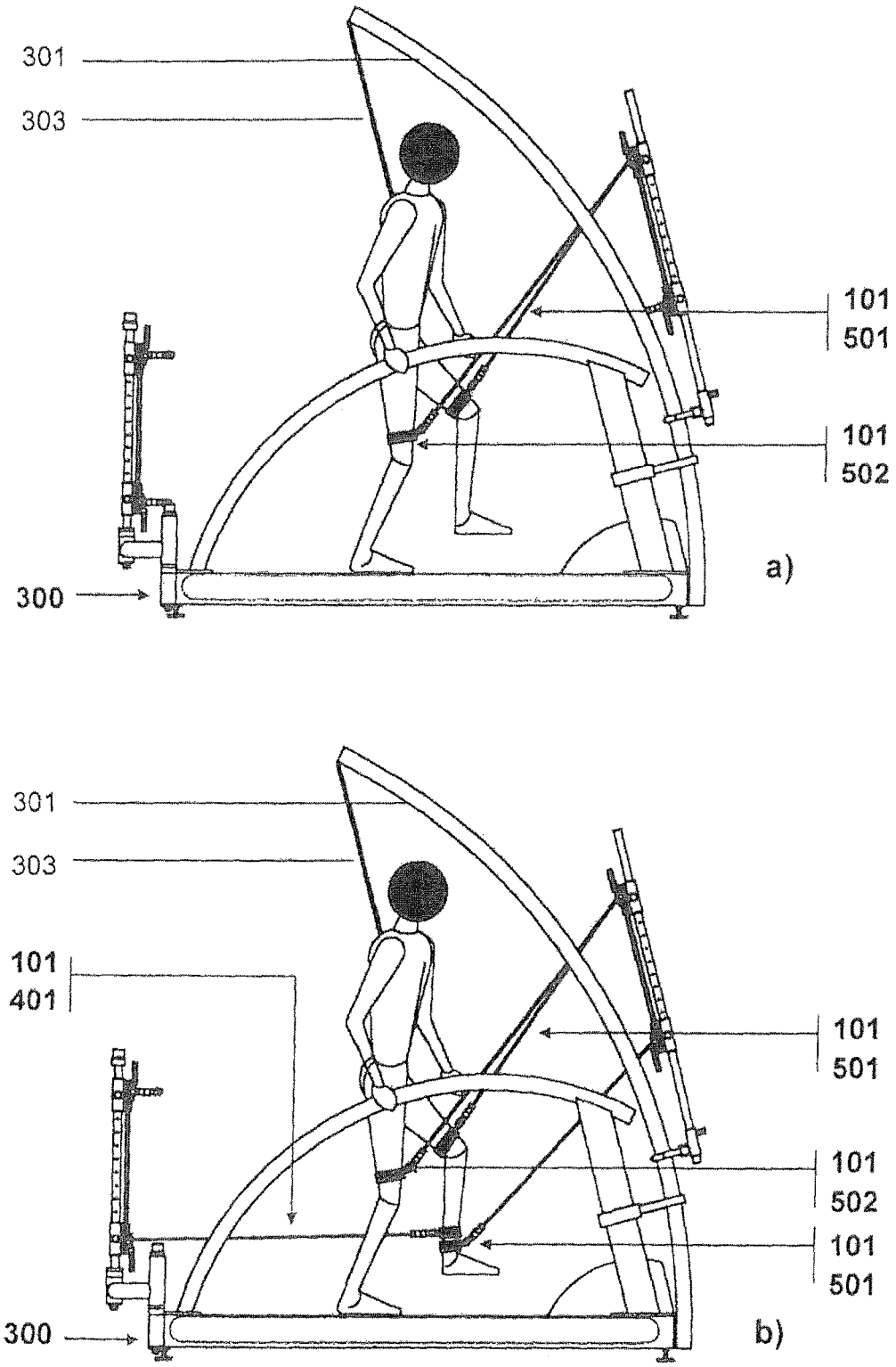
FIG. 10 shows as examples of exercises the therapeutic application of the rear training units, used as a pulling aid for the locomotion of handicapped persons (FIG. 10*a*), and the application with a still greater degree of handicap of the left leg, the front pulling unit being used as a damper against extension of the left leg (FIG. 10*b*))

According to FIGS. 7 and 8*f*, the adapter units 450 and 460 are fastened in the frame profiles 304 in such a way that, as a first step, the treadmill foot with fastening nut 458 is removed, the adapter units 450 and 460 are set against the frame profile 304, the treadmill foot with fastening nut 458 is screwed again through the fastening bore 453 of the flange plate at the bottom 452, and, as additional fastening, self-tapping screws 457, screwed into the thread 455 of the flange plate 454, are screwed end-on into the corners of the frame profile 304, is fastened, the stop 456 serving as an additional fixing aid during the fastening.

Figure 5:
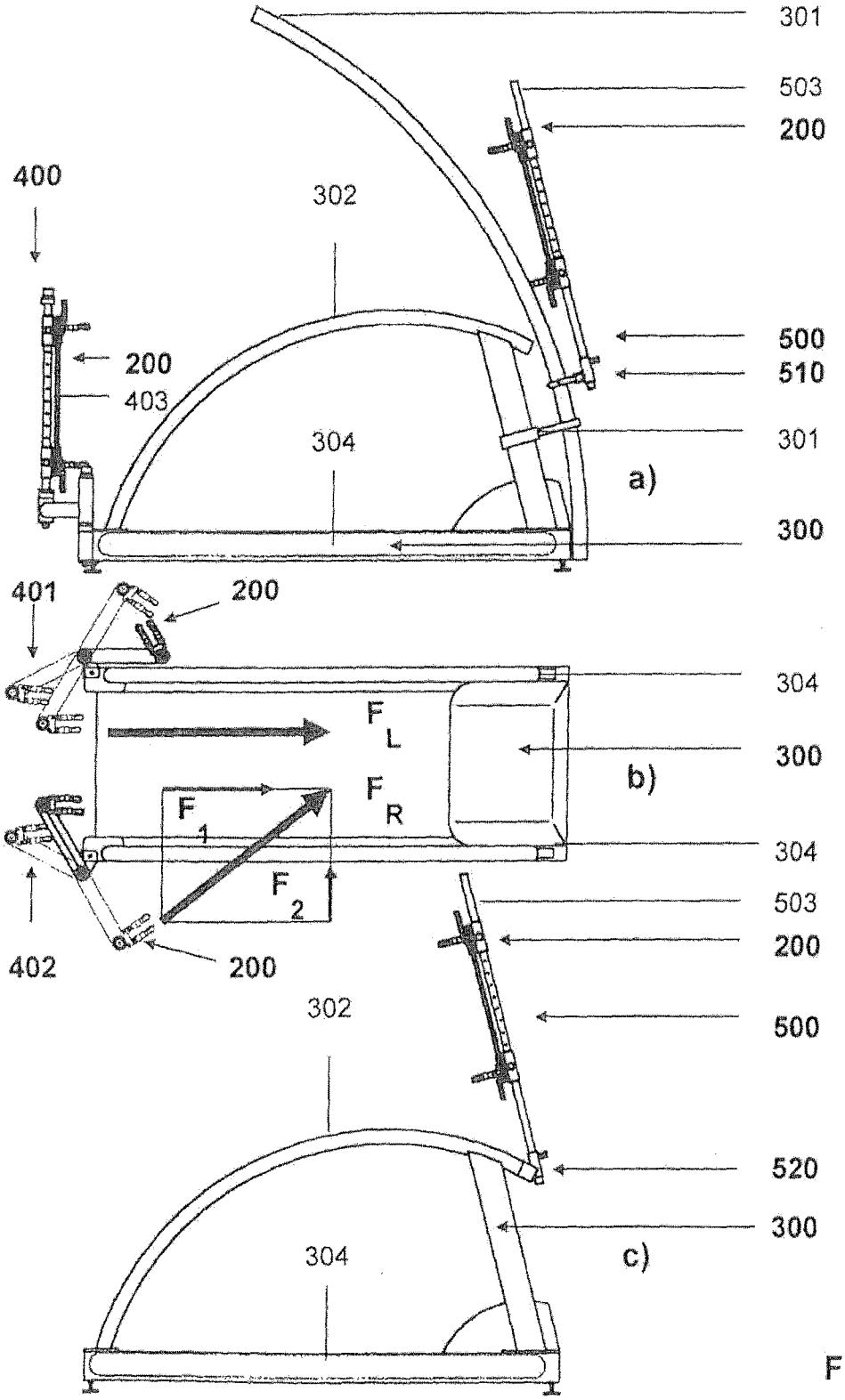
FIG. 5 shows in a side view (FIG. 5*a*)) a treadmill ergometer with adapted front and rear training units, the rear training unit being fastened to a weight-relieving and safety system, in a plan view (FIG. 5*b*)) the adjustment possibilities of the front training unit with different force pull-out angles, and in a side view (FIG. 5*c*)) the adaptation of the rear training unit directly into the profile cross sections of handrail tubes.

According to FIGS. 5, 6 and 8*a* and *b*, the rear training unit 500 is fastened by means of an adapter unit 510, consisting of a tube clip part 1 511 and a tube clip part 2 512 to a weight-relieving system 301 in such a way that the connecting screws 513 are led through the horizontal locking tube of the rear training unit 504 and through the tube clip part 2 512, and subsequently the connecting screws 513 are screwed into the tube clip part 1 511 and tightened.

For fastening the rear training unit 500, directly into the end faces of the handrails of the treadmill ergometer 302, according to FIGS. 8*c, d* and *e* a plug-in adapter 521, which is flange-mounted respectively on the left and right onto the horizontal locking tube of the rear training unit 504, and in which a sliding part 522 is respectively screwed on loosely by means of a fastening screw 523, is introduced into the end faces of the handrails of the treadmill ergometer 302. A frictional connection of the adapter units for treadmill handrails 520 to the handrails of the treadmill ergometer 302 is obtained by the subsequent screwing in and tightening of the fastening screw 523 into the sliding part 522, since, as a result of the respective inclined formation of the plug-in adapter 521 and the sliding part 522, both parts clamp with the inner sides of the handrails of the treadmill ergometer 302.

Figure 6:
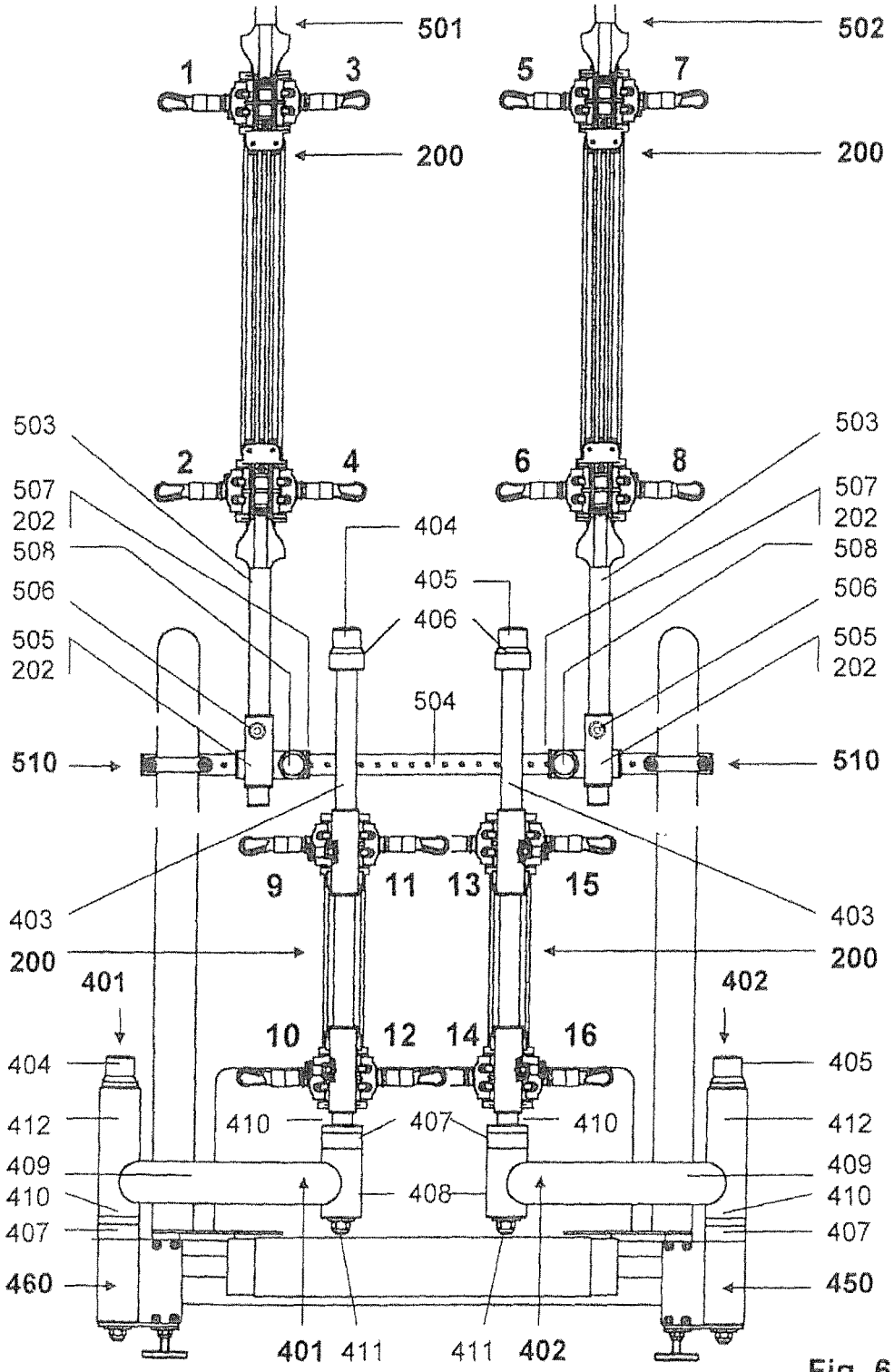
FIG. 6 shows in a front view a treadmill ergometer having an adapted front training unit and, on a weight-relieving and safety system, shown cut away for the sake of clarity, an adapted rear training unit.

FIGS. 6, 7*a* and 7*b* show the structure of the front left-hand training unit 401 and right-hand training unit 402, the pivot pins 420 of which, welded onto which is a pressure plate 407, are inserted into the receiving pins 451 of the adapter units 450 and 460, and are screwed with frictional engagement with the aid of the screw fastening of the pivot pin 421, after the left-hand training unit 401 and right-hand training unit 402 have first been aligned symmetrically with one another.

Above the pressure plate 407 there is a sliding plate 410, which is connected to the sliding bush adapter 419, and consequently makes it possible for the training units 401 and 402 to turn about the pivoting axis of the pivot pin 420 almost without any friction. The sliding bush adapter 419, into which the sliding bush 418 is inserted, is welded to the rotary tube 412. This rotary tube 412 has on the upper side a welded-on flange 417 for the adaptation of the locking element base 415, which is screwed by the screws 416 to the flange 417, and in which a sliding bush 418 is likewise inserted. The setting of the angular position of the training units 401 and 402 is realized by the locking elements 404 and 405, which respectively have a scaling, the scalings being turned in relation to one another, in order that the left-hand training unit 401 and right-hand training unit 402 can be set symmetrically in position in relation to one another. The fixing of the position of the training units 401 and 402 is ensured by the locking element base having a rigid toothed rim and a rotatable toothed rim, fastened in an interlocking manner to the pivot pin 420 by means of a feather key. For setting the angle, the locking head 413 is raised against the compressive force of the retaining spring 414, in order that the training units 401 and 402 can be turned. Once the desired angular position has been adopted, the locking head 413 is released again. The retaining spring 414 presses the locking head 413 back by way of the rigid and rotatable toothed rims of the locking element base 415, and thereby fixes the entire unit in an interlocking manner.

Respectively welded onto the rotary tube 412 of the front left-hand training unit 401 and the right-hand front training unit 402 are transverse tubes 409, and fixing bolts 408 are welded on their ends for fixing the pivot pins by screw fastening 411. This pivot pin 411, onto which a pressure plate 407 is welded, is inserted into the fixing bolts 408 of the front left-hand training unit 401 and to the right-hand front training unit 402 and is screwed with frictional engagement with the aid of the screw fastening of the pivot pin 411, once the pulling units 200, attached by way of the locking tubes 403, which respectively have on the upper side a flange 406 for the fastening of the locking elements 404 and 405, have first been aligned symmetrically in relation to one another. The fixing of the position of the locking tubes 403 is ensured by the locking element base 415 having fastened on the flange 406 a rigid toothed rim and a rotatable toothed rim, fastened in an interlocking manner to the pivot pin 411 by means of a feather key. For setting the angle, the locking head 413 is raised against the compressive force of the retaining spring 414, in order that the locking tubes 403 can be turned. Once the desired angular position has been adopted, the locking head 413 is released again. The retaining spring 414 presses the locking head 413 back by way of the rigid and rotatable toothed rims of the locking element base 415, and thereby fixes the position of the locking tubes 403 in an interlocking manner. The flanges 406 welded on the locking tubes 403, and the lower end of the locking tubes 403 respectively have pressed-in sliding bushes 418, which ensure turning of the pulling units 200 without any friction. Furthermore, for turning without any friction, a sliding plate 410 is inserted between the pressure plate 407 and the locking tubes 403.

As shown in FIG. 6, the rear left-hand training unit 501 and the right-hand rear training unit 502 are displaced and fixed on the horizontal locking tube 504 for positional adjustment by means of horizontal sliding tubes 507, into which square sliding bushes 202 have been introduced on both sides and which respectively have a locking pin 508. Respectively welded on the horizontal sliding tubes 507 are vertical sliding tubes 505, into which square sliding bushes 202 have been introduced on both sides and which respectively have a locking pin 506, in order that the vertical locking tubes 503 can be displaced and fixed in height.

Figure 2:
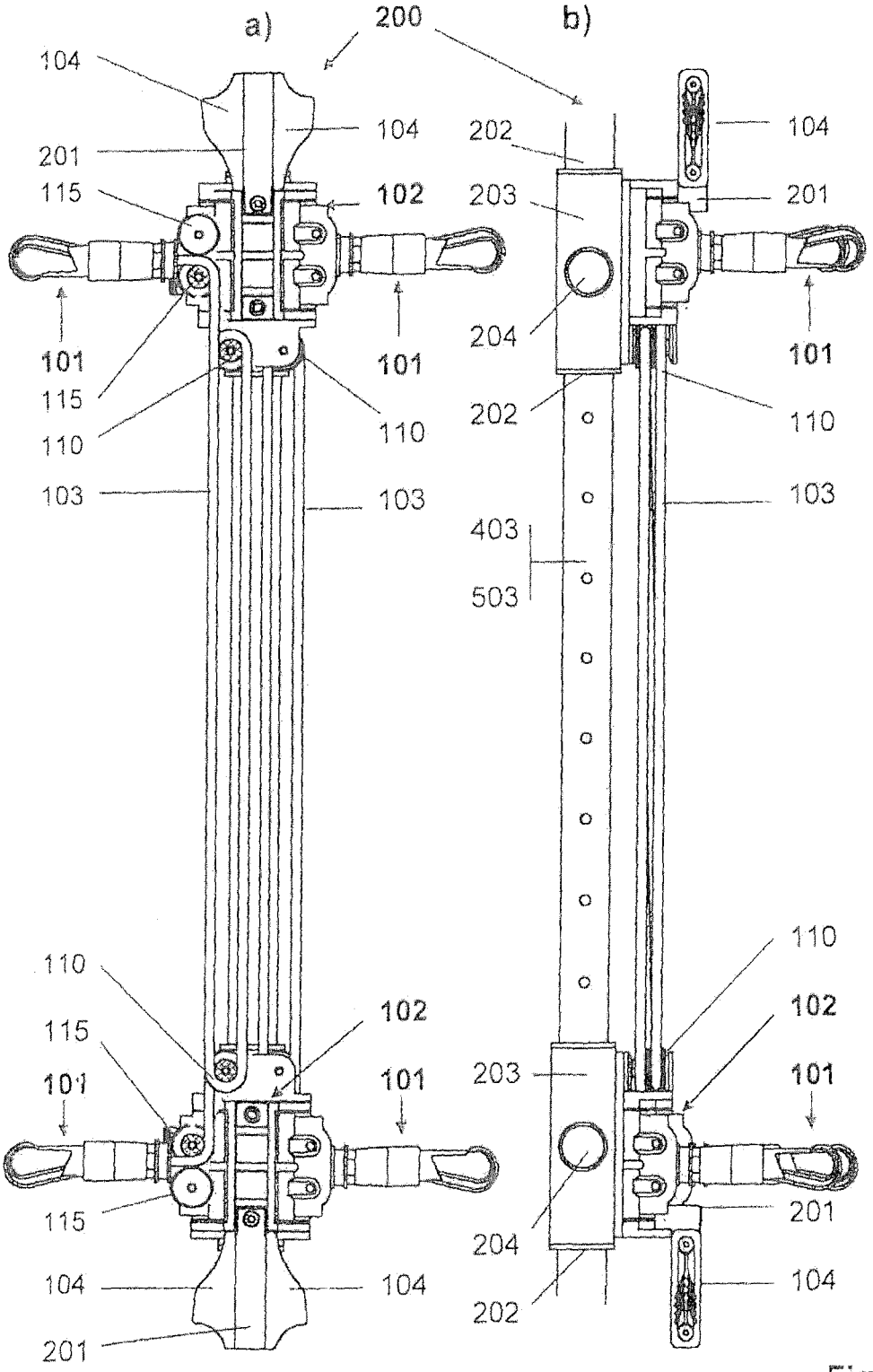
FIG. 2 shows the pulling units, modified for the attachment to a treadmill ergometer, in a front view (FIG. 2*a*)), and in a side view (FIG. 2*b*))

The pulling units 200 (FIG. 2) used in the front training unit 400 and in the rear training unit 500 are a modification of the pulling units 100 (FIG. 1), since they are not sufficient for use on treadmill ergometers 300 with respect to their adjustability. The pulling unit 100 has been modified in such a way that the pulling unit 200 now has a deflection roller unit 102, which is fastened on a sliding tube 203, into which square sliding bushes 202 have been pressed on both sides. The sliding tube is provided with a locking pin 204, which makes it possible that the deflection roller units 102 can be displaced on the respective locking tubes 403 and 503, and consequently the force pull-out can be variably set, or there is the possibility of reducing the training force by displacing the deflection roller units 102 in relation to one another. The displacing of the deflection roller units 102 meant that the belaying cleats 104 had to be integrated in this unit to be displaced, configured in such a way that the deflection roller units 102 incorporate a belaying cleat holder 201, onto which the belaying cleats 104 are screwed on both sides. The function of the deflection roller mechanism remains the same in this new configuration, configured in such a way that an elastic pulling cable 103 is inserted between the deflection rollers 115 of the deflection roller unit 102, is passed from outside over a deflection roller 110 of the opposite deflection roller unit 102, then placed from inside over the deflection roller 110 of the opposite deflection roller unit 102 and returned again to the opposite deflection roller unit 102 in such a way that the elastic pulling cable 103 is led out again between the deflection rollers 115. Both ends are subsequently fitted with the force-pulling unit 101, configured in such a way that the rubber buffer 109, the clamping screw 108, the stop sleeve 107 and the clamping sleeve with the scale 106 are placed one after the other over the elastic pulling cable 103, the end of the elastic pulling cable 103 is subsequently inserted into the pulling hook 105 and the clamping sleeve with the scale 106 is pressed by way of the pulling hook 105 for fixing the elastic pulling cable 103 in the pulling hook 105. Once the pulling unit 101 has been attached on both sides, it is adjusted in such a way that the stop sleeve 107 is pulled out from the deflection roller unit 102 by a specific fixed amount and the stop sleeve 107 is screwed with the clamping screw 108 onto the pretensioned elastic pulling cable 103. When the pulling unit 101 is being pulled out from the deflection roller unit 102, the elastic pulling cable 103 clamped within the pulling unit 101 is stretched in such a way that the clamping sleeve with the scale 106 protrudes from the stop sleeve 107 to such an extent that the indicated pulling force corresponds approximately to the actual pulling force. If this is not the case, the unit must be newly adjusted and the fixed amount when the elastic pulling cable 103 is pulled out must be newly set, during the adjustment. This amount must be respectively newly set for elastic pulling cables 103 of different strengths.

As represented in FIG. 6, it has proven to be absolutely necessary for the creation of a training concept that the respective force pulling-out units 101 are numbered on the deflection roller units 102 and elastic pulling cables 103 of different strengths are fitted in the pulling units 200. This claim has been realized by the pulling units 200 fitted in the rear training unit 500 being given the numbers 1-8 and the pulling units 200 of the front training unit 400 being given the numbers 9-16, and by the force pull-outs 1-2, 7-8, 9-10, 15-16 having weak elastic pulling cables 103 and the force pull-outs 3-4, 5-6, 11-12, 13-14 having strong elastic pulling cables 103, in order to suit each person undertaking training or each form of training.

Figure 3:
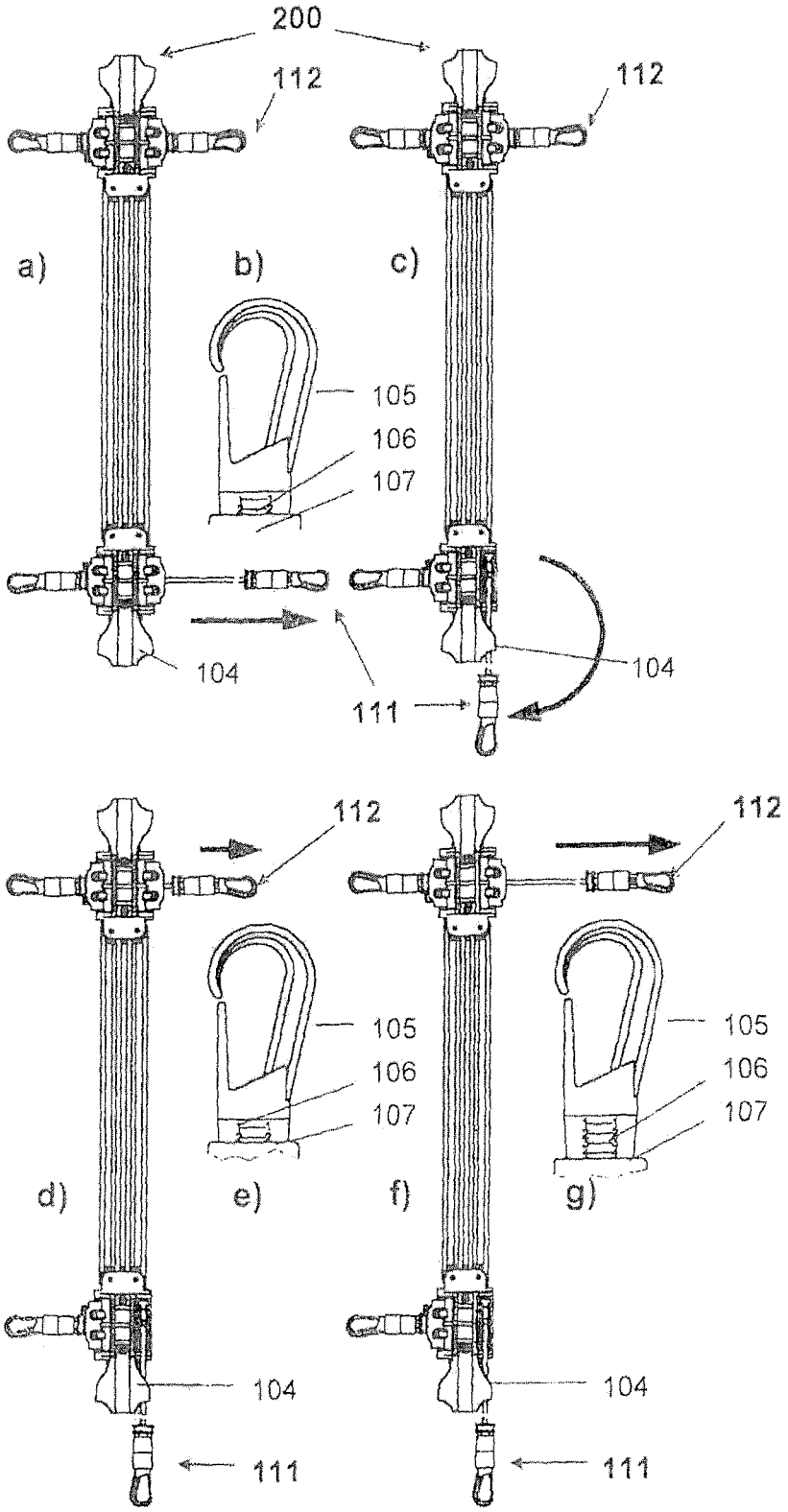
FIG. 3 shows the setting steps on a modified pulling unit for training with increased pulling force by pulling out the desired pull-out (FIG. 3*a*)), an enlargement of the indication of the desired increased pulling force (FIG. 3*b*)), the subsequent placing in the belaying cleat (FIG. 3*c*)), the subsequent pulling out of the actual training pull-out (FIG. 3*d*)), the increased initial force, identical in amount to the previously set increased pulling force (FIG. 3*e*)) in an enlargement, and the desired final force in the training sequence (FIG. 3*f*)), likewise in an enlargement (FIG. 3*g*))

FIG. 3 shows step by step, in different representations, the operating principle of increasing the force pull-out on the modified pulling unit 200 in such a way that, in a first step (FIG. 3*a*), the pull-out taken by way of example for increasing the pulling force 111 is pulled out up to the desired pulling force increase, which FIG. 3*b* shows in an enlargement, and, as FIG. 3*c* shows, the elastic pulling cable 103 is subsequently placed into the belaying cleats 104. During training on the pull-out taken by way of example 112, it is evident in FIG. 3*d* and in an enlargement (FIG. 3*e*) that, with the pull-out, training is performed immediately with the set increased pulling force and, with the same pull-out end position as during training without a pulling force increase, as FIG. 3*f* and in an enlargement FIG. 3*g* show, this pulling force is higher by the amount of the increase in the force pull-out.

Figure 4:
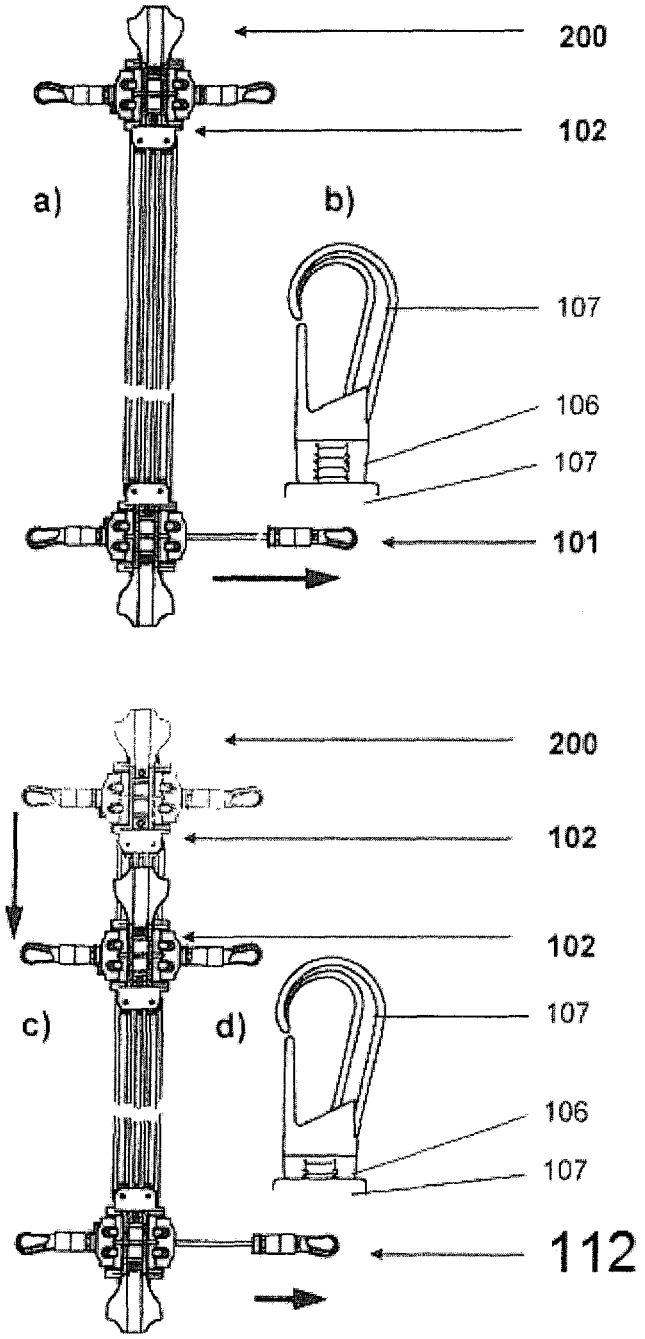
FIG. 4 shows the setting steps on a modified pulling unit for training with reduced pulling force by displacing the deflection roller units in relation to one another as an example of the difference in pulling force, with the same pulling-out length, in a first view (FIG. 4*a*)) and an enlargement of the indicated pulling force (FIG. 4*b*)), when training without a pulling force reduction, and a view with the displaced deflection roller unit (FIG. 4*c*)) with an enlargement of the indication of the reduced pulling force (FIG. 4*d*))

FIG. 4 shows step by step, in different representations, the operating principle of reducing the force pull-out on the modified pulling unit 200 in such a way that, in a first step (FIG. 4*c*), the deflection roller unit 102 is displaced with respect to the opposite deflection roller unit 102 and locked in place. FIG. 4*d* shows in an enlargement the pulling force in a specific pull-out end position, which with the same pull-out end position, as FIG. 4*a* and in an enlargement FIG. 4*b* show, is less, as a result of the displacement of the deflection roller unit 102.

Figure 12:
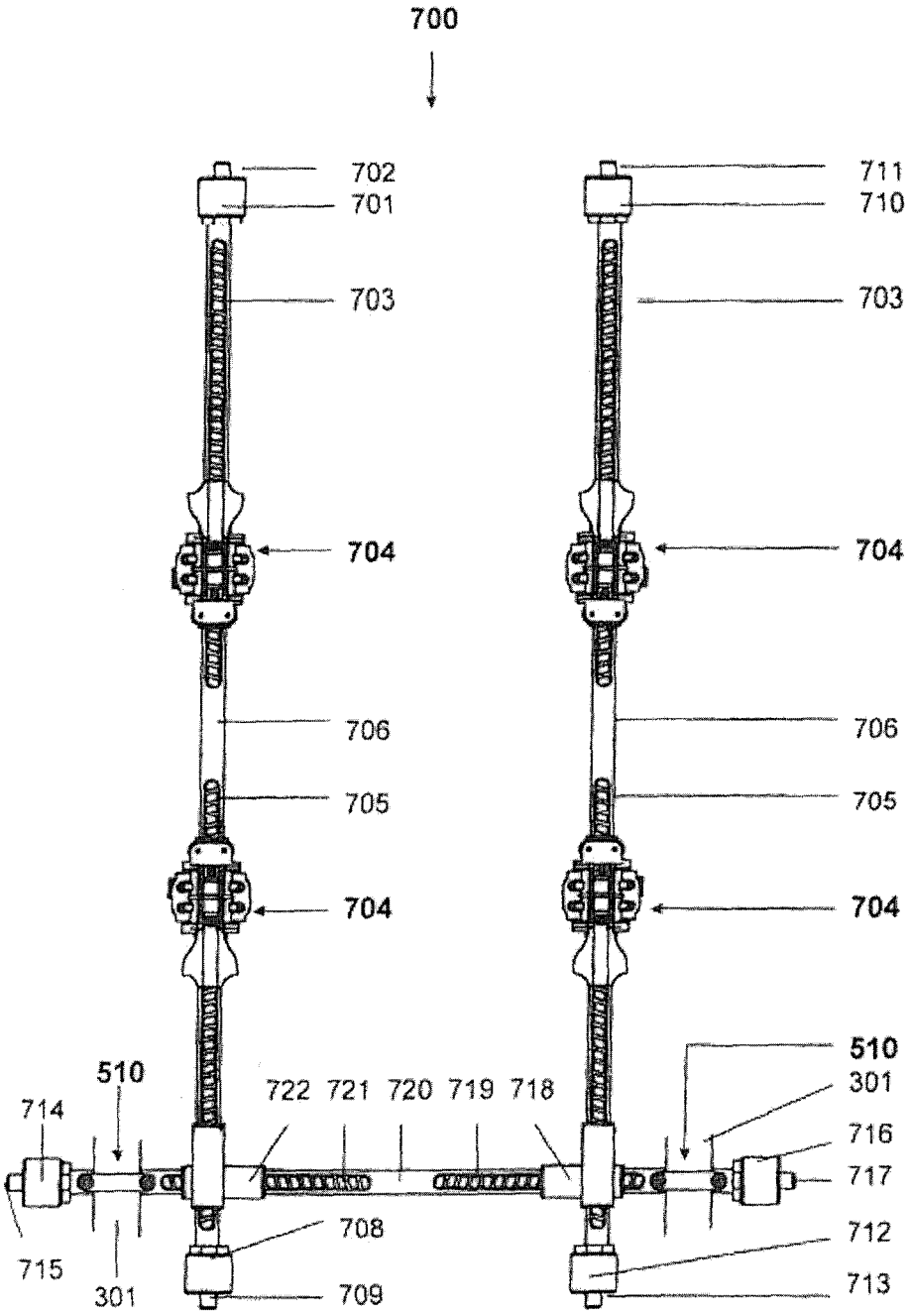
FIG. 12 shows a modified, rear training unit, which ensures a motorized positioning of the deflection roller units.
Figure 13:
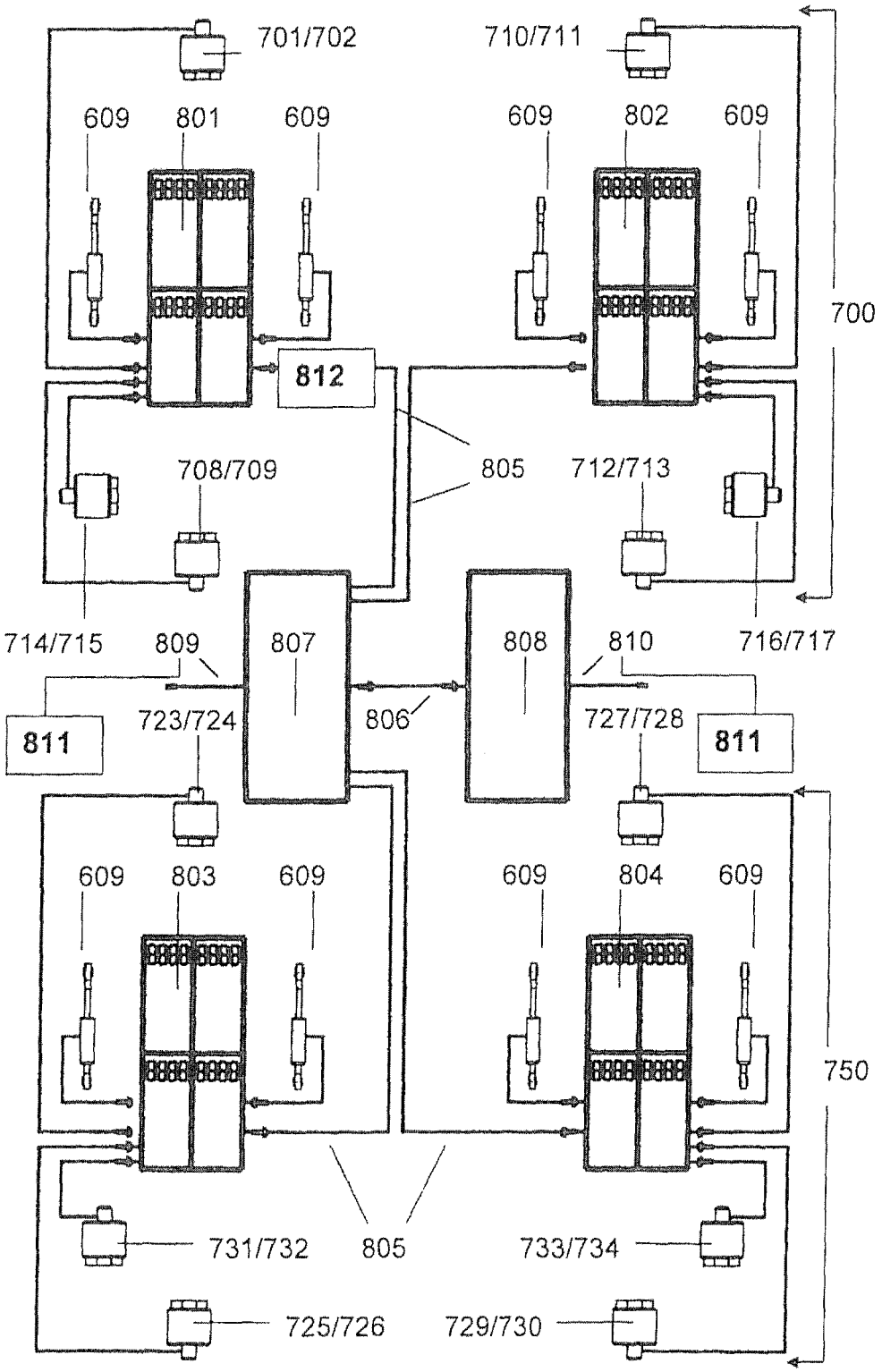
FIG. 13 shows the block diagram of the motor-adjustable front and rear training units, with the respectively integrated measuring units, the indicating displays on the respective training units, and the interlinking of the displays to a central control unit.

Since in many cases, in particular in medical applications or the determination of training data in performance sport, the indication and setting and adjustment of only approximately exact pulling forces and pulling directions on the force pull-out units 101 is not sufficient, in a further embodiment of the invention the use of measured-value sensors is described for pulling force determination in the pulling units (FIG. 11*a*) and in an enlargement (FIG. 11*b*), the electromotive positioning of the deflection roller units (FIG. 12), and the combination of the two further embodiments on the basis of a block diagram (FIG. 13).

As represented in FIG. 11*a* and in an enlargement FIG. 11*b*, a pulling unit with integrated measured-value sensors 600 may be provided which can measure, control and monitor parameters of training with treadmill ergometers. The parameters include step frequency, step length and work done. In FIG. 11*a*, the modified deflection roller units 602 are modified in such a way that the deflection rollers 110 are separated from the original deflection roller unit 102 and displaced into a measured-value sensor unit 601, configured in such a way that the deflection rollers 110 are adapted in a deflection roller holder 605, this deflection roller holder 605 is fastened to a guiding shaft 610, the guiding shaft 610 is led through a shaft guide 607 and the other end of the guiding shaft 610 is fastened to a fork head 608, in which one side of the measured-value sensor 609 is adapted, and a compression spring 606 is respectively fitted over the guiding shaft 610 between the deflection roller holders 605 and the shaft guide 607.

As represented in FIG. 11*a* and in an enlargement FIG. 11*b*, the fitting of the elastic pulling cable 103 is performed in such a way that it is inserted between the deflection rollers 115 of the deflection roller unit 602, is passed from outside over the deflection roller 110*a*, then placed from inside over the deflection roller 110*b* and returned again to the opposite deflection roller unit 602 in such a way that the elastic pulling cable 103 is led out again between the deflection rollers 115. Both ends are subsequently fitted with the force-pulling unit 101, configured in such a way that the rubber buffer 109, the clamping screw 108, the stop sleeve 107 and the clamping sleeve with the scale 106 are placed one after the other over the elastic pulling cable 103, the end of the elastic pulling cable 103 is subsequently inserted into the pulling hook 105 and the clamping sleeve with the scale 106 is pressed by way of the pulling hook 105 for fixing the elastic pulling cable 103 in the pulling hook 105, it also being possible when using the pulling units 600 to dispense with the fitting of the clamping screw 108 and the stop sleeve 107, since, by contrast with the conventional force pull-out units 101, the measured-value sensor unit 601 in any case significantly improves the exact indication of the pulling forces.

As represented in FIG. 11*a* and in an enlargement FIG. 11*b* on the basis of an example, increasing the pulling force with the pull-out taken by way of example 604 and/or training with the pull-out taken by way of example 603 has the effect of inducing a force F2 and/or F1, which respectively compress the compression springs 606 used, and results in a shortening S2 plus S1 of the pushrod 611 of the measured-value sensor 609, and consequently a change in the ohmic resistance thereof. This change in length is proportional to the forces of the pull-outs taken by way of example 603 and 604 and is merely dependent on the strength of the built-in compression springs 606 in the measured-value sensor unit 601. Which force corresponds to which change in length is determined for example by a commercially available calibrated electronic measuring balance, in that the measured-value sensors 609 are adjusted by the teach-in method. This method is shown in the further description of the invention.

As shown in FIG. 12, in an exclusive training unit 700, deflection roller units with an integrated spindle nut 704 are guided by way of vertically arranged spindle guides 706 with the aid of actuator motors 701 and 710, by turning of the upper threaded spindles 703, the respective position of the deflection roller units 704 being monitored by the incremental encoders 702 and 711 integrated in the actuator motors 701 and 710, and deflection roller units 704 are guided by way of vertically arranged spindle guides 706 with the aid of actuator motors 708 and 712, by turning of the lower threaded spindles 705, the respective position of the deflection roller units 704 being monitored by the incremental encoders 709 and 713 integrated in the actuator motors 708 and 712. The left-hand and right-hand sides of the training unit 700 are guided by way of horizontally arranged spindle guides 720 with the aid of actuator motors 714 and 716, by turning of the horizontally attached left-hand threaded spindle 721 and respectively the horizontally attached right-hand threaded spindle 719, the respective position of the left-hand and right-hand sides of the motor-adjustable pulling unit 700 being monitored by the incremental encoders 715 and 717 integrated in the actuator motors 714 and 716. In this case, the entrainment of the left-hand side takes place by a left-hand driver with an integrated spindle nut 722, the right-hand side by a right-hand driver with an integrated spindle nut 718.

On the basis of a block diagram, represented in FIG. 13, the function of the motor-adjustable front pulling unit 750 is realized by providing that, on the left-hand side, the actuator motors 723 and 725 with the respectively integrated incremental encoders 724 and 726 and, on the right-hand side, the actuator motors 727 and 729 with the respectively integrated incremental encoders 728 and 730 adjust the deflection roller units with integrated spindle nut 704 in the vertical direction, or monitor their position. The angular position of the left-hand and right-hand sides of the pulling unit 750 is realized with the aid of the rotary motors 731 and 733, and the respective angular position is monitored by the incremental encoders 732 and 734 integrated in the rotary motors 731 and 733.

FIG. 13 shows a block diagram of the exclusive complete equipment necessary in particular in medical applications or in the determination of training data in performance sport, such that the indicating displays 801 for the force pull-outs 1, 2, 3 and 4, 802 for the force pull-outs 5, 6, 7 and 8, 803 for the force pull-outs 9, 10, 11 and 12, 804 for the force pull-outs 13, 14, 15 and 16 are arranged over the respective measured-value sensor units 601. Connected to the display 801 is a measured-value sensor 609, and the actuator motors 701, 708 and 714 with the respectively integrated incremental encoders 702, 709 and 715, connected to the display 802 is a measured-value sensor 609, and the actuator motors 710, 712 and 716 with the respectively integrated incremental encoders 711, 713 and 717, connected to the display 803 is a measured-value sensor 609, and the actuator motors 723, 725 and the rotary motor 731 with the respectively integrated incremental encoders 724, 726 and 732 and connected to the display 804 is a measured-value sensor 609, and the actuator motors 727, 729 and the rotary motor 733 with the respectively integrated incremental encoders 728, 730 and 724. The displays are by interface cables 805 to a central system 807, which provides the power supply to the displays and has an interface converter, which ensures the secure bidirectional data transmission from the central system to the displays or vice versa. The data cable 806 realizes the bidirectional data traffic from the central system 807 to a central computer unit 808 and vice versa. For synchronization, in particular regulating the speed of the treadmill, brought about by the measured-value sensor units 601, there are 2 interface cables 809 and 810, which ensures the connection of the central system 807 and/or the connection of the central computer unit 808 respectively to the controller 811 of the treadmill.

Figure 11:
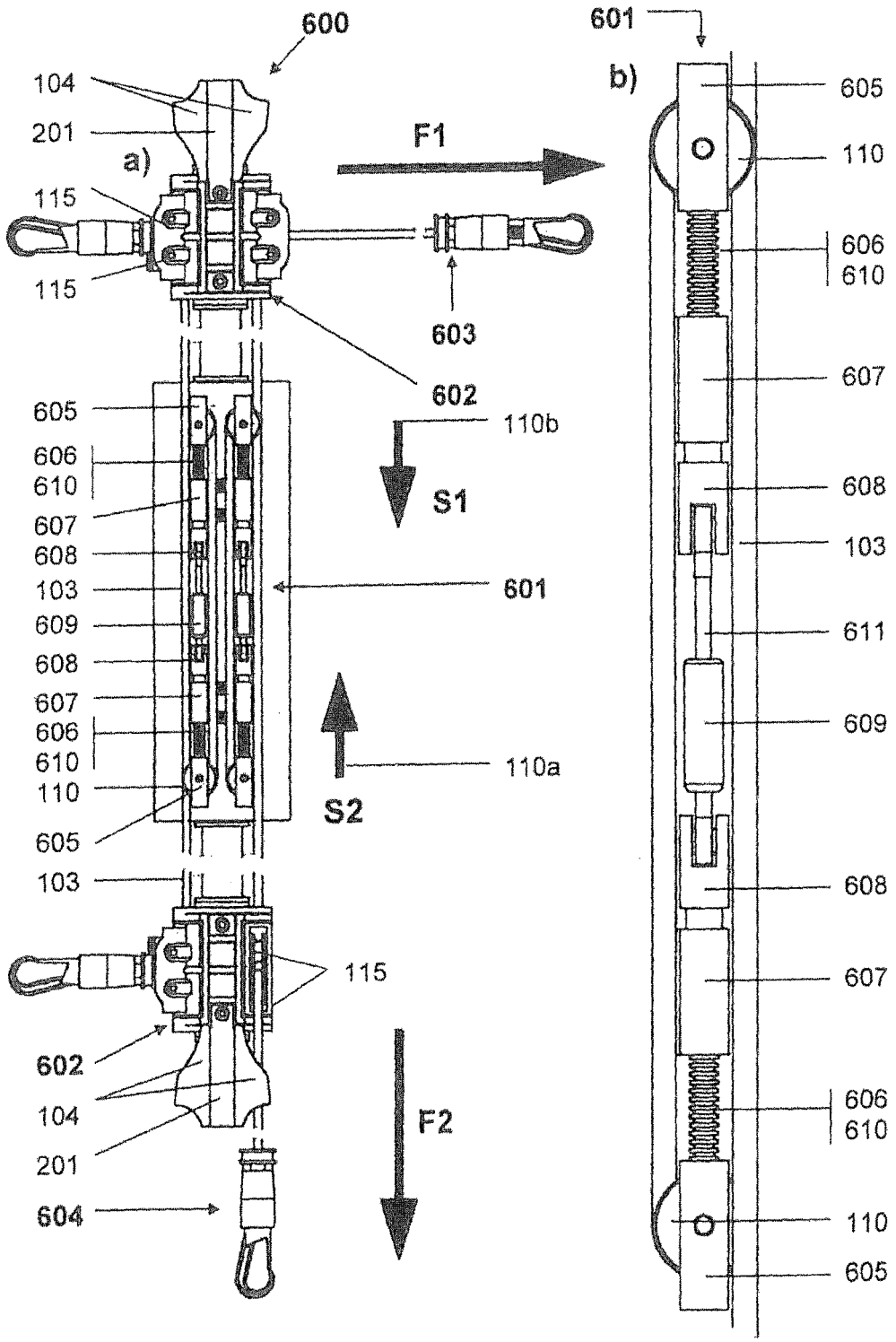
FIG. 11 shows the built-in integration of a measuring unit into the training units for the controlling, monitoring and documenting of all relevant training data in a plan view (FIG. 11*a*)), and in a side view (FIG. 11*b*))

As already mentioned and shown in FIG. 11 and FIG. 13, built into the measured-value sensor units 601 are measured-value sensors 609, which on account of cost-effective production are ideally formed as linear potentiometers. A specific pull-out length of the pushrods 611 of the measured-value sensors 609 in this case always corresponds to a specific ohmic value. Before the measured-value sensor 609 is used for determining all the training-relevant data and for controlling a training sequence, through to treadmill synchronization, the measured-value sensors built into the measured-value sensor units 601 must be adjusted in such a way that the measured-value sensor 609 to be adjusted is determined in a setting menu of the central computer unit 808, and this determination is transmitted to the corresponding display 801, 802, 803 or 804 by indicating a specific adjustment presetting, for example 1 Kp, subsequently a digital force-measuring balance is placed in the pulling hook, the force pullout unit 101 is pulled out until there is an indication of 1 Kp on the force-measuring balance, and this setting is then confirmed from the central computer unit 808. In this case, the analog signal of the measured-value sensor 609, in this case a specific ohmic value, is stored in a digitized form in an electrically programmable and alterable storage medium of the respective displays 801, 802,

803 or 804. This operation is repeated over a specific force range, the measured-value sensor 609 being adjusted more exactly the more measuring points over the possible force pull-out range have been adjusted. For reasons of cost effectiveness, this adjustment of a measured-value sensor 609 may be transferred by way of the central computer unit 808 to all the other displays, and subsequently also checked. In the technical embodiment of the invention, only the unchanging structure of the measured-value sensor units 601 is ultimately relevant in terms of whether this transfer of the training data can be realized, or each individual measured-value sensor 609 must be adjusted. A further possibility of adjustment is obtained by an adjusting device 812 being connected between the displays 801, 802, 803 or 804 and the central system 807 in such a way that the corresponding interface cables 805 can be pulled out from the corresponding display 801, 802, 803 or 804, and the adjusting device 812 can be connected in between. The use of an adjusting device 812, or the possibility of adjustment from the central computer unit 808, makes it possible for the displays to be produced at low cost, since, as a result of this external adjustment, it is possible to dispense with integration of a keyboard in the displays.

In an extended variant of the invention, the measured-value sensors and electronic controllers may be already integrated in the alternative pulling devices (for example a commercially available servo motor with a flange-mounted cable drum, magnetic lifting motor, pneumatic pulling device, etc.) and be connected and interlinked with the previously mentioned displays and computer units and interfaces.

Further embodiments and advantages of the invention are provided by the features that are further presented in the claims and by the exemplary embodiments specified below. The features of the claims may be combined with one another in any desired way as long as they are not mutually exclusive.

The invention claimed is:

1. A treadmill ergometer for therapeutic applications and/or intensive running training, comprising:

multiple force pull-out units that are connected to the treadmill ergometer;

right and left front training units that are connected to an entry of the treadmill ergometer;

right and left rear training units that are connected to an end of the treadmill ergometer; and a central computer unit and a central system that have an integrated power supply and an integrated interface converter, wherein the pull-out units are pivotally connected in their end region to the right and left front training units and to the right and left rear training units, respectively, and are configured for connection in their free end regions to at least one limb of a training person in such a way that, when there is movement of the limb, a force is exerted on the limb, the right and left front training units and the right and left rear training units are pivotally attached to the treadmill ergometer in such a manner that a position of each of the pull-out units can be set and held in various pull-out angles including an angle in a direction lateral to a longitudinal direction of the treadmill ergometer, each of the pull-out units is slidably connected to each of the front and rear training units in a horizontal and a vertical direction in such a manner that a position of each of the pull-out units can be set in various pull-out angles, forces and positions generated by the pull-out units are recorded, documented and predetermined by measuring instruments as a training plan, and the central computer unit and the central system are configured to activate an actuator and rotary motors, to evaluate incremental encoders and measured-value sensors by bidirectional data transfer, and to consequently preset training parameters and stipulate settings, wherein pulling-out positions of the force pull-out units on the treadmill ergometer can be set in the front training units in a vertical direction, by displacing and engaging on locked tubes, and in a horizontal direction, by turning the left front training unit, which can be set and fixed by two locked elements, and/or the right front training unit, which can be set and fixed by two locked elements, in such a way that the pulling-out positions of the force pull-out units can be set in regions that are located in front of or to the side of the treadmill ergometer and have at least one setting range of 270° in relation to a longitudinal direction, and the pulling-out positions of the force pull-out units can be set in a rear training unit in the vertical direction, by displacing and engaging on locked tubes, and in the horizontal direction, by displacing and engaging on a locked tube, the rear training unit including the left rear training unit and the right rear training unit, which can respectively be displaced on their own on the respective locked tubes and be fixed by being locked in place.

2. The treadmill ergometer as claimed in claim 1, wherein each force pull-out unit is configured to be pulled out elastically and each has a pulling cable.

3. The treadmill ergometer as claimed in claim 1, wherein the force pull-out units can be pulled out from pulling units, which respectively have two opposing deflection roller units, and further comprising:

belaying cleats for fixing the pulling units, said cleats being able to be brought into different positions, so that pulling-out forces can be varied, in particular increased, and deflection roller units formed such that they can be displaced and fixed in relation to one another, so that the pulling-out forces can be varied, in particular reduced.

4. The treadmill ergometer as claimed in claim 3, wherein the front training units and the rear training units contain pulling units with integrated measured-value sensors, which can measure, control and monitor parameters for training with treadmill ergometers, said parameters including; the pulling-out forces, pretensioning forces, step frequency, step length, work done and speed synchronization of the treadmill ergometer.

5. The treadmill ergometer as claimed in claim 4, wherein a linear potentiometer is built into a measured-value sensor unit as a measured-value sensor.

6. The treadmill ergometer as claimed in claim 4, wherein each measured-value sensor is formed as a load cell or as a magnetic-field-induced unit.

7. The treadmill ergometer as claimed in claim 4, wherein each measured-value sensor can be adjusted by an externally connectable adjusting device and by way of a central computer unit, in such a way that a specific change in length of a pushrod of the measured-value sensor always corresponds to a specific force that is induced by pulling out the force pull-out units.

8. The treadmill ergometer as claimed in claim 1, wherein motor-adjustable deflection roller units are inserted in a motor-adjustable rear pulling unit and/or a motor-adjustable front pulling unit.

9. The treadmill ergometer as claimed in claim 1, wherein the front training units and the rear training units are attached individually on their own or in various combinations to the treadmill ergometer, realized in such a way that there are adapter parts which allow for the respective attachment.

10. The treadmill ergometer as claimed in claim 1, wherein the treadmill ergometer has incorporated on a running surface thereof a commercially available force measurement and/or pressure distribution device, which provides on a display a visual check-back indication to a test person and thus shows a success of a gait pattern improvement.

11. The treadmill ergometer as claimed in claim 10, wherein the force measurement and/or pressure distribution device electronically controls the pull-out units in such a way that the gait pattern (i) corresponds to presettings and/or standard values.

12. The treadmill ergometer as claimed in claim 1, wherein the treadmill ergometer has alternative pulling devices, which integrally contain measured-value sensors and electronic controllers, each alternative pulling device being a commercially available servo motor with a flange-mounted cable drum, a magnetic lifting motor, or a pneumatic pulling device, which is connected and interlinked with displays and computer units and interfaces that are present.

* * * * *